US005469155A

United States Patent [19]

Archambeault et al.

[11] Patent Number: 5,469,155

[45] Date of Patent: Nov. 21, 1995

[54] WIRELESS REMOTE BORING APPARATUS GUIDANCE SYSTEM

[75] Inventors: John T. Archambeault, Joliet, Ill.; David J. Gasmovic, Simpsonville, S.C.; Morio Mizuno, Iwakura, Japan

[73] Assignee: McLaughlin Manufacturing Company, Inc., Greenville, S.C.

[21] Appl. No.: 273,278

[22] Filed: Jul. 11, 1994

Related U.S. Application Data

[63] Continuation of Ser. No. 9,447, Jan. 27, 1993, abandoned.

[51] Int. Cl.[6] ..... G01V 1/00; E21B 7/04

[52] U.S. Cl. ..... 340/853.4; 340/853.3; 340/856.1; 340/853.6; 175/45; 324/326

[58] Field of Search ..... 340/853.3, 853.4, 340/853.5, 853.6, 853.1, 854.6, 856.1; 367/77; 175/45, 61, 62; 324/326, 346, 329

[56] References Cited

U.S. PATENT DOCUMENTS

| | | | |
|---|---|---|---|
| 3,617,865 | 11/1971 | Hakata . | |
| 4,403,664 | 9/1983 | Sullinger | 175/24 |
| 4,714,118 | 12/1987 | Baker et al. . | |
| 4,806,869 | 2/1989 | Chau et al. . | |
| 4,821,815 | 4/1989 | Baker et al. . | |
| 4,881,083 | 11/1989 | Chau et al. | 324/346 X |
| 4,993,503 | 2/1991 | Fischer et al. | 175/62 |
| 5,133,417 | 7/1992 | Rider | 175/45 |
| 5,155,442 | 10/1992 | Mercer | 324/690 |
| 5,231,355 | 7/1993 | Rider et al. | 324/326 |
| 5,264,795 | 11/1993 | Rider | 324/326 |
| 5,363,926 | 11/1994 | Mizuno . | |

OTHER PUBLICATIONS

Advertisement–"DigiTrak" Drill Head Monitor Straightline Manufacturing, Inc.

Advertisement–Radiodection RD400SL Information, Radiodetection Corporation (Ridgewood, NJ) c/o Telco Sales, Inc., Elkhorn, Wisc.

Advertising Brochure–"SpotDtek" Pipe and Cable Locator (No. 776–16/292) McLaughlin Boring Systems, Greenville, S.C.

*Primary Examiner*—Ian J. Lobo

*Attorney, Agent, or Firm*—Dority & Manning

[57] ABSTRACT

Guidance system for an underground boring device that includes a receiver for signals from a signal generator associated with an underground boring head. A wireless transmitter is provided for transmitting the information about the boring head from a boring head location to an initial location where the boring device is controlled.

8 Claims, 3 Drawing Sheets

WIRELESS REMOTE BORING APPARATUS GUIDANCE SYSTEM

This is a continuation, of application Ser. No. 08/009,447 abandoned, filed Jan. 27, 1993, which was abandoned upon the filing hereof.

BACKGROUND OF THE INVENTION

The present invention relates generally to underground boring devices and, more particularly, to a novel underground boring control system for transmitting information relating to the boring from a boring head location to a remote location via wireless means.

In horizontal boring systems in general, and particularly, in directional boring systems, it is desirable to monitor and be aware of a number of types of information with respect to the boring head. In directional boring, typically a signal-generating probe is utilized associated with the boring head for producing a signal that can be picked up by a surface-located receiver and displayed on a screen thereat. Such a signal may include information with respect to location of the probe, depth of the probe and like type information. It is then incumbent upon the operator utilizing the surface receiver to communicate with the operator of the directional boring device to advise him of the particular necessary information for continuing the boring operation in the appropriate direction.

Such transfer of information has in the past been accomplished by verbal communication between the operator of the device receiving the signal from the underground probe to the operator of the boring device. However, a multitude of information may be displayed at the location of the probe that then must be conveyed over some distance and often over the noise of running machinery back to the operator of the directional boring device. This has proved problematical and inconvenient in actual use by the known methods such as, for example, voice transmission via walkie-talkie.

As used herein, boring device includes directional boring, i.e., that type boring device whose boring head may be controlled in the direction in which it goes from an operator of the directional boring device, as well as conventional boring that goes substantially in a uniform direction from the boring device. These types of boring are used primarily for boring beneath existing highways and structures to provide for the placement of cable, pipe or the like without disruption to the highway or structure currently in existence. This is also sometimes referred to as horizontal boring. Further, in the context of the present invention, boring is intended to include drill and auger type systems as well as pneumatic or hydraulic piercing tools.

In a directional boring apparatus, the boring or cutting head is shaped so that when turned in a particular direction, it can be driven in that direction, and therefore, the directional aspect of the system. Thus, it is desirable for the operator of the directional boring device to know the location of the boring head, its depth below the ground, the pitch of the boring head as well as its angular orientation or roll, i.e., the sloped surface of the boring head located toward the surface at a twelve o'clock position or at a six o'clock position, etc. It may also be desirable for the operator to have information as to the remaining battery life of the signal generator probe and/or the temperature of the directional boring head.

SUMMARY OF THE INVENTION

The present invention recognizes and addresses the disadvantages of the prior art. Accordingly, it is an object of the present invention to provide an improved guidance system for an underground boring device.

It is another object of the present invention to provide an improved means of conveying predetermined data from a boring head location to an operator of a boring machine.

It is a further object of the present invention to provide an improved means of transmitting information from a remote boring location to a boring device operator.

It is another object of the present invention to provide an improved system for guiding a directional boring device.

It is yet another object of the present invention to provide an improved boring system that allows the boring device operator to be able to view information about the boring head while operating the boring device.

These and other objects are achieved by providing an improved guidance system for an underground boring device that includes means for wireless receipt of signals from a signal generator associated with the boring device, the signals containing information about the boring device. Means for wireless transmission of the boring device information received from the signal generator to a remote receiver is provided, as well as a remote receiver for receiving the transmitted information from the means for wireless transmission. The remote receiver includes display means for producing a display representing the information about the boring device. The information about the boring device may include the location of the boring device, the depth below the surface of the earth, the pitch of the underground boring device, the angular location or roll of the underground boring device, as well as information relating to the battery life of the signal generator and the temperature of the boring head.

The means for wireless receipt includes a graphic display or an audio synthesizer or any other suitable mechanism for conveying the information to an operator. In a preferred embodiment, the means for transmission transmits data and image signals and the transmission of the information received from the signal generator to the remote receiver is in real time.

DESCRIPTION OF THE DRAWINGS

A full and enabling disclosure of the present invention, including the best mode thereof, to one of ordinary skill in the art, is set forth more particularly in the remainder of the specification including reference to the accompanying figures in which.

Figure 1:
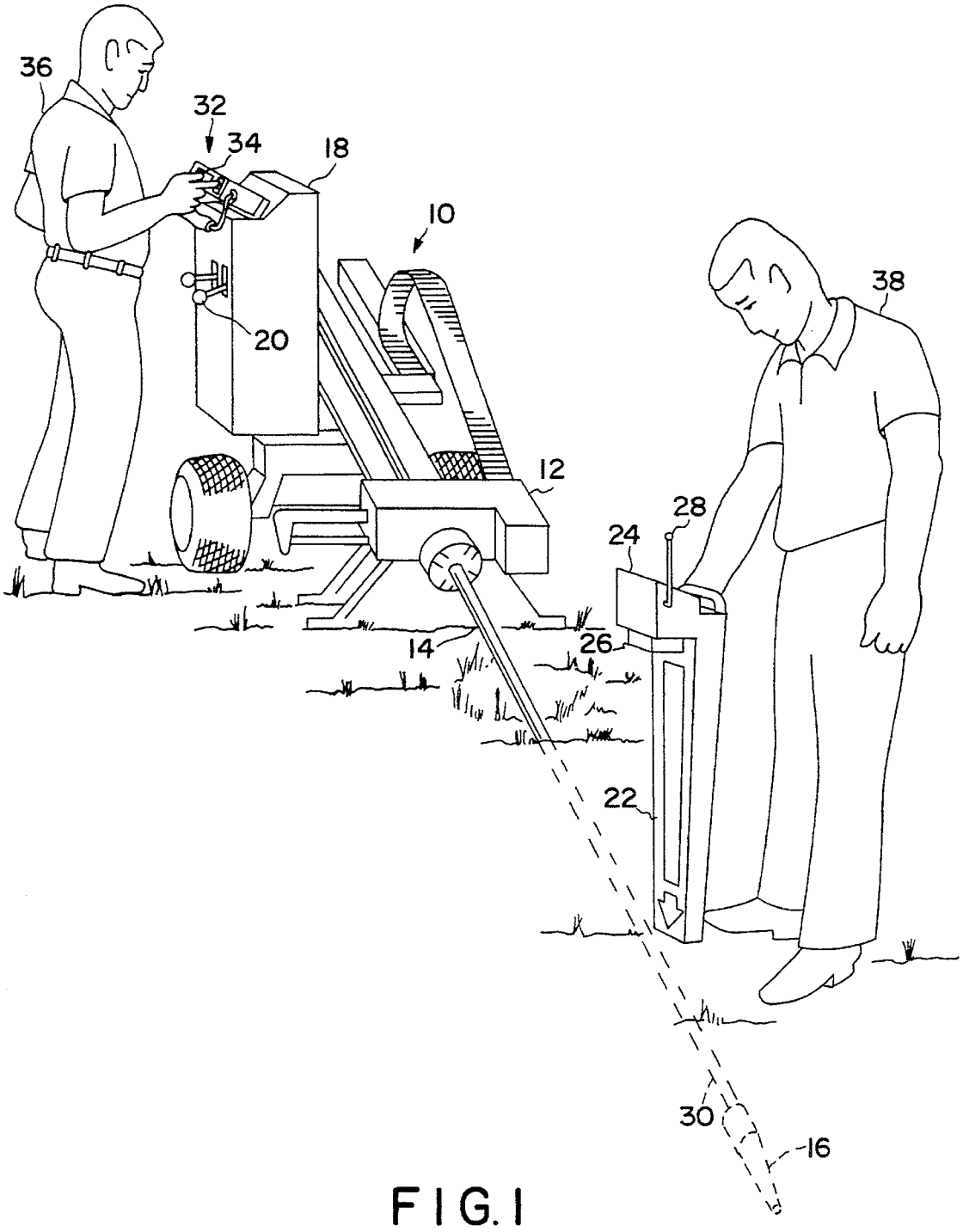
FIG. 1 is a perspective view of a wireless remote boring system in accordance with an embodiment of the present invention.

Repeat use of reference characters in the present specification and drawings is intended to represent same or analogous features or elements of the invention.

DETAILED DESCRIPTION

Referring to FIG. 1, a directional boring device 10 in accordance with an embodiment of the present invention is illustrated. A boring machine 12 is located in an initial position and includes a boring rod 14 and a directional boring head 16. The boring machine includes a control panel 18 with actuators 20 for controlling the operation of the boring device. In accordance with the present invention, means for wireless receipt of signals from a signal generator are provided. As illustrated herein, the means for wireless receipt of signals from a signal generator includes a receiver 22. Receiver 22 includes a display 24 and a means for wireless transmission of the boring device information received from the signal generator to a remote receiver. As embodied herein, the means for wireless transmission includes a wireless transmitter 26 with an antenna 28.

A signal generating probe 30 is located generally adjacent boring head 16 for emitting signals containing information about the boring device as will be discussed in more detail below. The improved guidance system further includes a remote receiver 32 located generally adjacent the boring machine 12 for receiving the transmitted information from transmitter 26 via wireless transmission. Remote receiver 32 includes a display 34 so that the operator 36 of the boring device can see and/or hear the information transmitted from transmitter 26.

In general, the method of operation of the improved guidance system for the underground boring device is as follows. A workman 38 at a distant location from the boring machine 12 utilizes receiver 22 to receive a signal from signal generating probe 30, which signal contains information with respect to the boring head 16. Such information may be, for example, its location, its depth below the ground, its pitch, its angular position or roll, its temperature, and/or the remaining battery life of the probe. This information is received by receiver 22 as will be described in more detail below and is processed and displayed on display 24 at this location.

Substantially simultaneously and in real time, transmitter 26 transmits signals carrying the information that is displayed on display 24 to the remote receiver 32 via wireless transmission. Remote receiver 32 processes these signals and displays them on display 34. Both data and image signals may be transmitted between the wireless transmitter 26 and remote receiver 32. Thus, operator 36 at the boring device is able to obtain real time information with respect to the boring head just as the workman 38 is able to obtain this information at the location of the boring head. The particular mechanisms for accomplishing this with respect to a preferred embodiment will be described in more detail below.

Figure 2A:
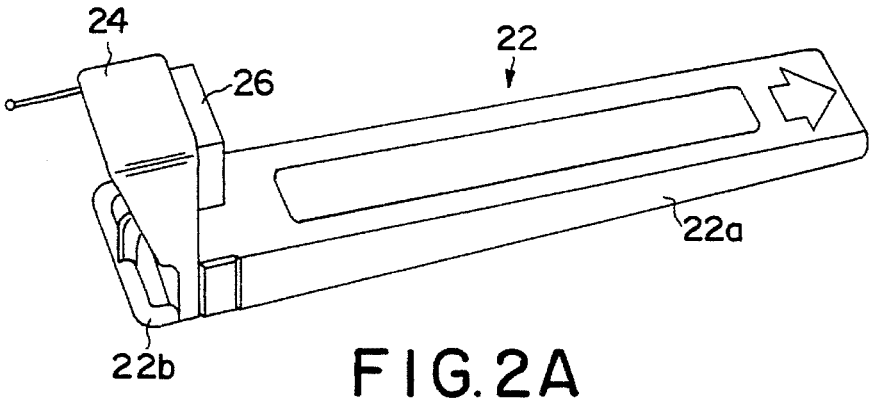
FIG. 2A is a perspective view of a receiver/transmitter in accordance with an embodiment of the present invention.
Figure 2B:
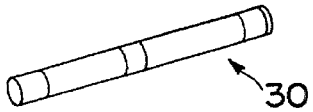
FIG. 2B is a perspective view of a signal generating probe.

Referring to FIGS. 2A and 2B, receiver 22 and signal generating probe 30 are illustrated. Receiver 22 includes a longitudinally extending plastic casing **22*a* which houses the receiving mechanism. Integral with housing 22*a* is a display 24 and a handle 22*b* for positioning the receiver. Attached to the receiver is a wireless transmitter 26 whose operation will be described in more detail with respect to FIG. 5. Housing 22*a* includes a plurality of horizontal spaced apart coils 23 (shown in phantom in FIG. 2A) for receiving signals from the signal generating probe 30. Signal generating probe 30 generates a magnetic field that contains information with respect to the probe that is indicative of the boring head 16. The multiple coils 23 in housing 22*a* utilize the field gradient of the magnetic field from the signal generator to generate information as to the location and depth of the boring head. The particular mechanism for generating the signals representative of information concerning the boring head, and the particular mechanism of receiving this information as is done by receiver 22 does not form an essential part of the present invention in and of itself. One preferred method of measuring the signal generated by signal generating probe 30** is to measure the field gradient rather than the magnetic field strength in a manner as disclosed in U.S. Pat. No. 3,617,865 dated Nov. 2, 1971, the disclosure of which is incorporated herein by reference in its entirety.

In a preferred embodiment, the frequency of the signal output by the signal generator is approximately 38 KHz. Of course, any suitable frequency may be utilized such as, for example, 1.2 KHz, 9.5 KHz, 114 KHz, etc.

Figure 4:
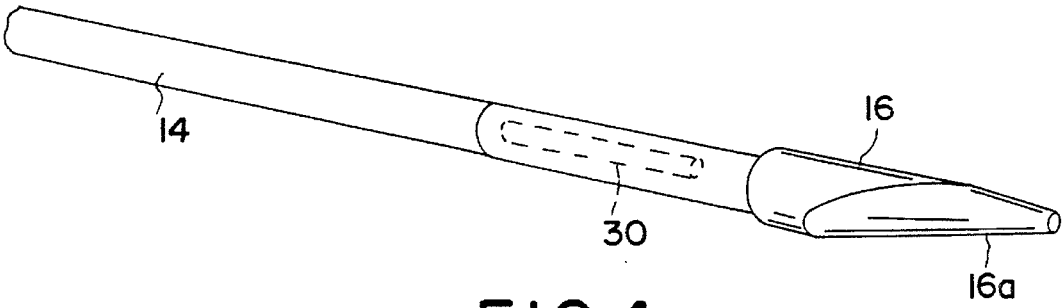
FIG. 4 is a perspective view of a directional boring head associated with a signal generating probe and drill rod.

Probe 30 in a preferred embodiment consists of a ferromagnetic core with copper windings through which an electrical current is placed to generate a magnetic field that is received by receiver 22 as set forth in U.S. Pat. No. 3,617,865. Probe 30 may be of varying types, depending on the application desired, and be capable of providing a variety of types of information. For example, the location and depth of the probe (and, consequently, the boring head) may be measured by determining the field gradient of the magnetic field generated by probe 30. Mercury switches may be provided in probe 30 around its inside perimeter so as to indicate the angular position or roll of the boring head. When the boring head is rotated to a particular position, the appropriate mercury switches will close and therefore, angular position information is generated. As is indicated in FIG. 4, a directional boring head 16 has a sloped portion **16*a* for controlling the direction of the boring head in conjunction with the propulsion of the boring machine. With information as to the angular location of sloped portion 16*a***, the boring head can be oriented to proceed in the desired direction. This is referred to herein as the roll of the directional boring head.

In addition, probe 30 may contain a cradle-type switch for indicating the pitch above or below a horizontal plane or a plane parallel to the surface of the ground that the directional boring head is located. Finally, indicators may be contained in the boring head and probe to indicate the battery life remaining in the probe or signal generator 30 as well as the temperature of the boring head. All of this information may be conveyed to the receiver through the magnetic field generated by the signal generator. It should be appreciated by one skilled in the art that, although receiving a magnetic field is one preferred embodiment, any suitable type system for determining the desired information about the boring head would be within the scope of the present invention. In addition, while the signal generator is referred to herein as a probe, it should be appreciated that other types of signal generators would also be within the scope of the present invention.

Figure 3:
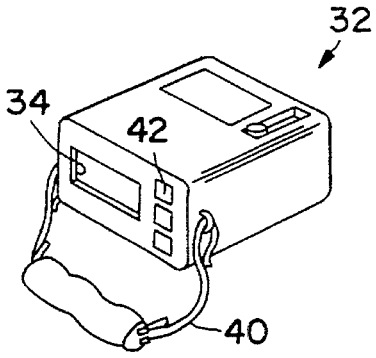
FIG. 3 is a perspective view of a remote receiver/display in accordance with an embodiment of the present invention.

Referring to FIG. 3, a more detailed view of remote receiver 32 is illustrated. Remote receiver 32 may be held around the neck of operator 36 by strap 40 or mounted to boring machine 12 in any suitable fashion. Receiver 32 contains a display 34 for displaying the information received from wireless transmitter 26. Display 34 is capable of displaying information identical to the information displayed on display 24 so that the operator 36 of the boring machine will have the same information as the operator 38 located at the boring head. In a preferred embodiment, display 34, as well as display 24, includes a clockface readout for indicating the angular position or roll of the boring head in quadrants, as well as indicators for the remaining information as discussed above. It should be understood that a graphic or visual display is one preferred form of display, but within the meaning of display as used herein, a voice or audio synthesizer could be substituted or other appropriate audible tones sufficient to convey the appropriate information to the operator. In addition, remote receiver 32 includes a touch pad control panel 42 for selecting the desired information to be displayed, adjusting the volume of the audible signal, or for other purposes as would be apparent to one skilled in the art. Display 24 has similar controls.

Referring to FIG. 4, directional boring head 16 includes a sloped surface 16*a* for assisting in the directional propulsion of the boring head as described above. Boring head 16 is connected through boring rod 14 to boring machine 12. A component of the boring rod 14 contains a compartment into which the signal generating probe 30 may be inserted for generating the appropriate signals to convey the information with respect to the boring head as described above.

Figure 5:
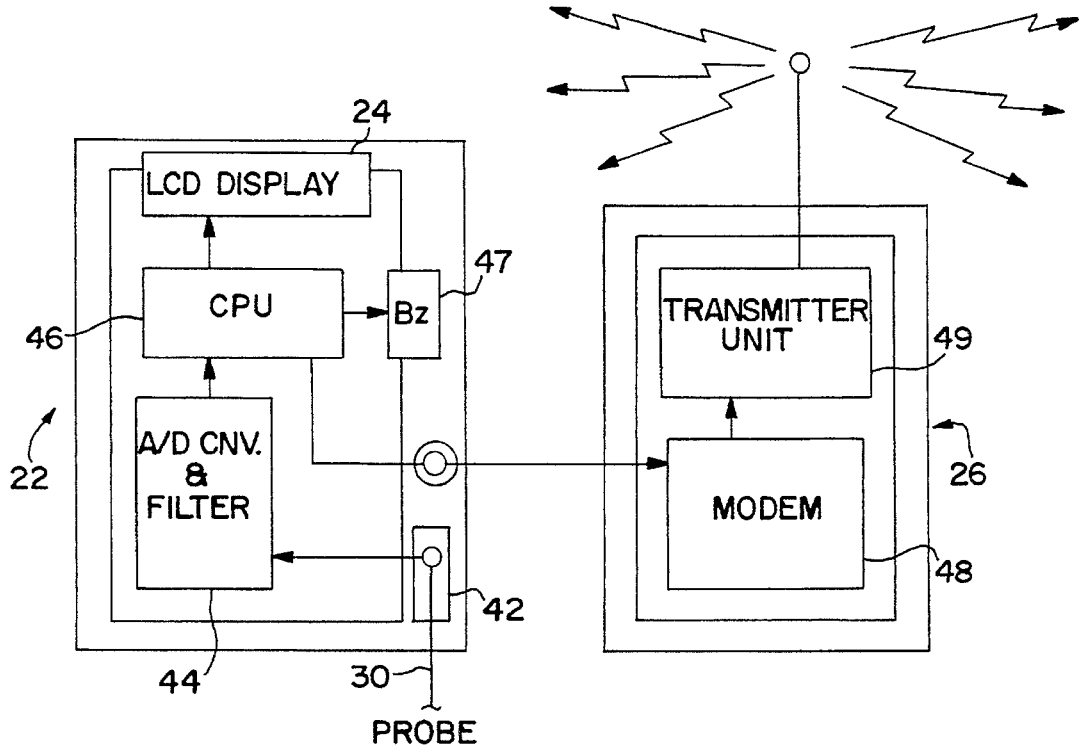
FIG. 5 is a block diagram illustrating the operation of a receiver/transmitter unit in accordance with an embodiment of the present invention.

Referring to FIG. 5, a block diagram is illustrated providing the operational characteristics of receiver 22 and wireless transmitter 26 to one skilled in the art. As illustrated, receiver 22 receives a signal generated by signal generating probe 30 via a magnetic field as is described above with respect to U.S. Pat. No. 3,617,865, or otherwise, and as would be readily apparent to one skilled in the art. The dual coil mechanism described above is illustrated at 42 in FIG. 5. The signal received by coils 42 is filtered and converted from an analog signal to a digital signal at 44. The digital signal is then processed in a central processing unit 46 to generate the appropriate audible signal as illustrated at speaker 46 and the appropriate visual signal through display 24. The conversion of the received signals from the probe to a visual display and audible output as illustrated in FIG. 5 is done in a conventional manner as would be apparent to one skilled in the art. An example of a known commercial product suitable for this function is the Micro Computerized Pipe Locator marketed by McLaughlin Boring Systems, 2006 Perimeter Road, Greenville, S.C. 29605, under the product number MPL-H5.

In accordance with the present invention, central processing unit 46 simultaneously and in real time conveys a signal representative of the information displayed on display 24 and sent to audible means 47 to wireless transmitter 26. Wireless transmitter 26 includes a frequency shift keyed modem 48 for receiving the signal from a central processing unit 46 and a transmitter chip 49 for transmitting the signal via wireless means to remote receiver 32. In a preferred embodiment, the digital signal is transmitted between receiver 22 and transmitter 26 at 1200 bits per second. Also in a preferred embodiment, between modem 48 and transmitter 49, the "1" component of the digital signal is transmitted on a frequency of 1300 Hz and the "0" component of the digital signal is transmitted at approximately 2100 Hz. Of course, these are by way of example only.

Wireless transmitter 26 is capable of transmitting data and image signals and may be of any conventional type wireless transmitter with such capabilities. In a preferred embodiment, wireless transmitter 26 has selectable bands and transmits on a frequency of 469.50 MHz or 469.550 MHz with an output power of 18 milliwatts. Of course, these are by way of example also. In a preferred embodiment, the transmitter circuit corresponds to the Federal Communications No. ID-APV0290 standard. The wireless transmitter is capable of transmitting both data and image signals and transmits the signals to the remote receiver 32 substantially simultaneously with the display on display 24, thereby providing real time information to the operator 36 of the boring machine 12.

Figure 6:
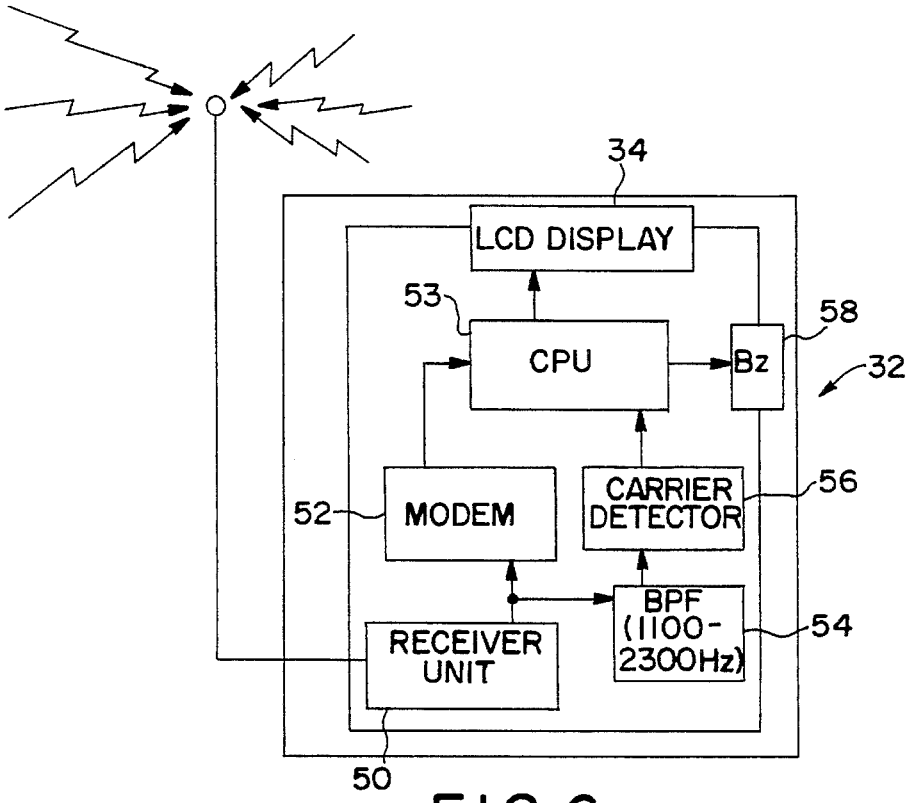
FIG. 6 is a block diagram illustrating the operation of a remote receiver unit in accordance with an embodiment of the present invention.

Referring to FIG. 6, the signal transmitted by wireless transmitter 26 is received by remote receiver 32 at receiver unit 50. Receiver unit 50 receives on the same frequency that transmitter 49 transmits on. In a preferred embodiment, such frequency is 469.50 MHz or 469.550 MHz. The circuitry utilized in remote receiver 32 also corresponds to FCC standard No. ID-APV0290. The signal received at 50 is transmitted via frequency shift keyed modem 52 to central processing unit 53. In a preferred embodiment, this is an 8-bit signal and represents the display and audio components of the signal transmitted to receiver 32. A band pass filter 54 and carrier detector 56 may be utilized to filter and enhance the signal provided to the central processing unit 53. The filter 54 may filter signals, for example, outside of a range of 1100–2300 Hz. In this embodiment, carrier detector 56 provides a 1-bit signal to central processing unit as to whether a radio wave is sending or not, and this controls the receipt by the central processing unit 53. The signal between receiver unit 50 and band pass filter 54 is conveyed as described above with respect to the signal between modem 48 and transmitter 49 with respect to the frequencies. The central processing unit 53 processes the signals to produce an image on display 34 as well as an audible component if desired via speaker 58. It should be appreciated that both transmitter 26 and receiver 32 may be of conventional design for the wireless transmission of data and image signals, the particulars of which are not essential to the present invention.

These and other modifications and variations of the present invention may be practiced by those of ordinary skill in the art, without departing from the spirit and scope of the present invention, which is more particularly set forth in the appended claims. Furthermore, those of ordinary skill in the art will appreciate that the foregoing description is by way of example only, and is not intended to be limitative of the invention so further described in such appended claims, and that the aspects of varying embodiments may be interchanged in whole or in part.

What is claimed is:

1. A boring apparatus useable by at least two operators to produce an underground bore substantially horizontally through the earth from an initial location, said apparatus comprising:

a boring machine having a boring rod including a directional boring head, said boring machine further including manipulative controls actuatable by a first operator to guide said boring head;

a signal generating probe associated with said boring head for generating informational signals about said boring head including information indicative of the location and depth thereof;

a portable assembly adapted to be carried by a second operator during operation at a location approximately directly above the boring head, said portable assembly including a first graphic display device for producing a first visual display indicative of information about said boring head;

said portable assembly further including a probe receiver for directly receiving the informational signal from said signal generating probe, said probe receiver operatively connected to said first graphic display device for yielding the first visual display;

said portable assembly further including a transmitter for wirelessly transmitting the informational signal from the portable assembly;

a receiver device located at the boring machine, said receiver device including a second graphic display device for producing a second visual display indicative of information about the boring head;

said receiver device operative to receive the informational signal as wirelessly transmitted by said transmitter of said portable assembly, said receiver device operatively connected to said second graphic display device for yielding the second visual display, whereby said first operator and said second operator may each view a visual display showing information about the boring head such that the second operator may keep the portable assembly substantially directly above the boring head and the first operator may control the direction of the boring head.

2. A boring apparatus as set forth in claim 1, wherein said transmitter of said portable assembly and said receiver device respectively transmit and receive on a carrier frequency falling within a range of approximately 469.50 MHz to 469.550 MHz.

3. A boring apparatus as set forth in claim 1, wherein said information about said boring head contained in said informational signal includes an angular location of said boring head.

4. A boring apparatus as set forth in claim 3, wherein said first graphic display and said second graphic display each include a clock face display to visually represent the angular orientation of said boring head.

5. A boring apparatus as set forth in claim 1, wherein said signal generating device generates a magnetic field carrying said informational signal, said magnetic signal being received by said probe receiver.

6. A boring apparatus as set forth in claim 1, wherein said information about said boring head contained in said informational signal further includes information indicative of remaining battery life of said signal generating probe.

7. A boring apparatus as set forth in claim 1, wherein said information about said boring head contained in said informational signal includes information indicative of a temperature of said boring head.

8. A boring apparatus as set forth in claim 1, wherein said information about said boring head contained in said informational signal includes information indicative of a pitch of said boring head.

* * * * *